US007447452B2

(12) United States Patent
Burry et al.

(10) Patent No.: US 7,447,452 B2
(45) Date of Patent: Nov. 4, 2008

(54) METHOD AND SYSTEM FOR IMPROVING ELECTROPHOTOGRAPHIC RUN COST THROUGH CYCLIC EFFICIENCY OF THE CHARGING DEVICE

(75) Inventors: Aaron M. Burry, West Henrietta, NY (US); Christopher A. Dirubio, Webster, NY (US); Eric S. Hamby, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 237 days.

(21) Appl. No.: 11/555,398

(22) Filed: Nov. 1, 2006

(65) Prior Publication Data

US 2008/0101807 A1 May 1, 2008

(51) Int. Cl.
*G03G 15/02* (2006.01)

(52) U.S. Cl. ..... 399/50; 399/43

(58) Field of Classification Search ..... 399/9, 399/24, 26, 38, 42, 43, 48, 50
See application file for complete search history.

(56) References Cited

U.S. PATENT DOCUMENTS 3,781,105 A 12/1973 Meagher
6,611,665 B2 8/2003 DiRubio et al.
6,898,385 B2 * 5/2005 Ito et al. ..... 399/50
7,054,574 B2 * 5/2006 Facci et al. ..... 399/89
2004/0136740 A1 7/2004 Shoji
2008/0152371 A1 * 6/2008 Burry et al. ..... 399/50

* cited by examiner

*Primary Examiner*—Hoan H Tran
(74) *Attorney, Agent, or Firm*—Oliff & Berridge, PLC

(57) ABSTRACT

The life of the photoconductor in an image forming apparatus is typically limited by the eventual occurrence of some form of print quality defect related to the photoconductor. One of the typical failure mechanisms is the slow wearing away of the surface layer of the photoconductor. Photoconductor run life is improved by operating a charging station in a low wear mode during certain circumstances, including: during printing of a low stress page as detected based on the image data; during at least one of cycle up and cycle down operations to control charging of the at least one photoconductor over at least one print zone for at least one cycle of rotation of the at least one photoconductor; during printing of at least one test patch in a process control cycle; and upon determination from the image data that at least one photoconductor will not contribute to the printing during a next print cycle.

21 Claims, 10 Drawing Sheets

PHOTOCONDUCTOR WEAR DEPENDENCE ON CHARGING CURRENT

DEPENDENCE OF WEAR RATE ON CHARGING ACTUATOR

NORMALIZED RUN COST ESTIMATE VERSUS JOB LENGTH

METHOD AND SYSTEM FOR IMPROVING ELECTROPHOTOGRAPHIC RUN COST THROUGH CYCLIC EFFICIENCY OF THE CHARGING DEVICE

BACKGROUND

A method and system to improve electrophotographic run cost makes an active adjustment of charge device actuator settings based on various conditions and states of an image forming apparatus.

Image forming apparatus, such as a xerographic reproduction apparatus, use a photoconductor in the form of a drum or a belt in the creation of electrostatic images upon which toner is deposited and then transferred to another electrostatically charged belt or drum, or to paper or other media. Once the toner image is transferred, most xerographic apparatus clean the photoconductor.

The life of the photoconductor in a xerographic print engine is typically limited by the eventual occurrence of some form of print quality defect related to the photoconductor. One of the typical failure mechanisms is the slow wearing away of the surface layer of the photoconductor. For example, the thickness of the photoconductor will decrease through use over time, typically through contact friction with various other devices in the system (e.g., the transfer roller). Certain types of charging devices, such as AC-biased charging rolls (BCRs) are known to accelerate the wear rate of the photoconductor surface. The more cycles the photoconductor makes with the AC BCR operating at its high AC bias, the faster the photoconductor will wear. Because of the nature of the photoconductor, a change in its thickness will result in a change in its electrostatic performance. Eventually, after enough of the surface layer has been worn away, print quality defects begin to appear in the customer's prints. An example of this type of defect is the charge depleted spots defect that appears in certain print engines after approximately 10-12 um of the photoconductor outer layer (charge transport layer) has been worn away.

SUMMARY

To prevent these sorts of defects, some image forming apparatus make use of a page counter and a hard-stop on the photoconductor device. This forces a change of the photoconductor device after a predetermined number of prints or copies have been made. Thus, the photoconductor is replaced with a new one prior to a sufficient amount of the charge transport layer wearing away to cause print quality defects.

Because photoconductors are typically expensive to replace, the life of these devices can have a significant impact on the overall run cost of the image forming apparatus. This is because one of the largest contributors to the parts costs for the image forming apparatus is the replacement of printer cartridges, which contain the photoconductor. Moreover, because the dominant reason for requiring a change of the printer cartridge is the wear of the photoconductor, the life of the photoconductor can have a significant impact on the overall run cost of the apparatus. An example of this is shown in FIG. 1, which illustrates various run cost contributors for a typical image forming apparatus.

In the past, many of the efforts to enable longer life photoconductors have focused on the development of materials based solutions; more robust materials for the surface of the photoconductor, less abrasive cleaner blade surfaces, toners that provide higher levels of lubrication to the cleaning blade, etc. Some of the past efforts have also focused on the development of various charging devices, such as non-contact charging devices with relatively large spacings (typically larger than for example a non-contact, or gapped BCR approach), that would impart less stress onto the photoconductor surface as part of the charging process. Unfortunately, such methods can require significant investments to develop these materials and/or devices. In addition, many micro-tandem print engines still make use of BCR charge devices. Thus, wear of the photoconductor with this type of charging device is still an important issue.

In accordance with exemplary embodiments of the disclosure, active adjustment of charging device actuator settings of the image forming apparatus is achieved during use of the device to reduce the photoconductor wear to control charging of at least one print zone of the photoconductor.

In an exemplary embodiment, a method and system provide an image forming apparatus with a contact-type charge device in which active adjustment of contact charging device actuator settings are based on image content information for a customer's print job to reduce the wear. In accordance with an aspect of this embodiment, the method and system operate the charge device in a low wear mode when the photoconductor is not contributing to the print. For example, in a full color printer with multiple colors besides black, there may be a particular photoconductor, such as the cyan photoconductor, that is not in use during a print containing only black and white. The charger associated with that color may operate in a reduced or low wear mode, Additionally, in accordance with another aspect, the method and system operate the charge device in a low-wear (reduced print quality) mode during printing of low stress pages, such as pages containing large amounts of text.

In accordance with another exemplary embodiment, a method and system provide an image forming apparatus with a charge device that operates in a low wear mode at least while in inter-document (ID) zones between pages, which may typically encompass up to about 25% of the total operational time of a print job, or in other regions of the print job that are less susceptible to charging related defects. The use of this set of significantly less stressful actuator settings during these portions of the customer image stream may then help to extend the life of the photoconductor surface, thereby improving the overall run cost for the image forming apparatus.

In accordance with a further exemplary embodiment, the method and system provide an image forming apparatus with a charge device that operates in a low wear mode during process control cycles, which generate one or more test patches on the photoconductor and typically may make up about 4-5% of the cycles of the image forming apparatus.

In accordance with a further embodiment, the method and system operate the charge device in a low wear mode during cycle up and cycle down, when the image forming apparatus is being initiated or shut down prior to or after a print job.

In accordance with one aspect, the low wear mode may be implemented by running a biased charge roll in a purely DC mode.

In accordance with another aspect, the low wear mode may be implemented by running the biased charge roll in an AC mode near or below the "charging knee." In such a mode, the biased transfer roll for that station may be operated at a reduced transfer field to prevent dark spots from transferring from the photoconductor to the intermediate belt. This is useful when the photoconductor is not contributing to the print.

When one or more of the above charge controls are implemented, the life of the photoconductor may be increased and the run cost decreased substantially compared to non-controlled operation. For example, run cost savings from low wear biased charge roll operation within inter-document zones and process control cycles can be up to about 22% for certain image forming apparatus. However, the savings could be significantly higher if other embodiments described above are also implemented. For example, run costs for short print jobs could be reduced by up to a factor of 9× for certain image forming apparatus by using low wear biased charge roll operation during cycle-up and cycle-down routines. However, the actual savings for this approach will depend on the average length of customer print jobs, as well as the number of photoconductor drum cycles required during each cycle-up/cycle-down.

In certain embodiments, the method and system of the disclosure may be coupled with the teachings of commonly-assigned, co-pending U.S. patent application Ser. No. (ID/20051613) to provide voltage level feedback and generate even higher run cost savings. Whereas this related disclosure makes no use of image content information in the selection of the appropriate charging actuator settings, and instead bases its actuator settings on feedback from voltage readings, the current disclosure may use this image content information to achieve even further photoconductor wear rate and run cost improvements.

Various ones of the above aspects may be achieved by an image forming apparatus, comprising: at least one photoconductor having at least one printing zone; a photoconductor charging system selectively operable in one of a nominal charging mode and a low wear mode, the low wear mode operating at a reduced setting that reduces wear on the at least one photoconductor; and a control unit that receives image data used to print an image in the at least one printing zone, wherein the control unit sets the photoconductor charging system to the low wear mode to charge the at least one photoconductor based on the image data.

Various ones of the above aspects may also be achieved by an image forming apparatus, comprising: at least one photoconductor having at least one printing zone; a photoconductor charging system selectively operable in one of a nominal charging mode and a low wear mode, the low wear mode operating at a reduced setting that reduces wear on the at least one photoconductor; and a control unit that receives image data used to print an image in the at least one printing zone, wherein the control unit sets the photoconductor charging system to the low wear mode to charge the at least one photoconductor when at least one of the following conditions are present:

(1) during printing of a low stress page as detected based on the image data;

(2) during at least one of cycle up and cycle down operations to control charging of the at least one photoconductor over at least one print zone for at least one cycle of rotation of the at least one photoconductor;

(3) during printing of at least one test patch in a process control cycle; and (4) upon determination from the image data that at least one photoconductor will not contribute to the printing during a next print cycle.

Embodiments may significantly improve the life of a photoconductor in a xerographic engine by actively adjusting the charger settings for a charging station used in an image forming apparatus. Embodiments may actively adjust the charging actuator (peak-to-peak voltage or AC current) to reduce the amount of positive charge deposited onto the surface of the photoconductor, thereby extending its life, and reducing the possibility of charging related print quality defects.

BRIEF DESCRIPTION OF THE DRAWINGS

The foregoing and further objects, features and advantages will become apparent from the following description of preferred embodiments with reference to the accompanying drawings, wherein.

DETAILED DESCRIPTION OF EMBODIMENTS

Exemplary embodiments of a method and system for improving run cost in an image forming apparatus will be described with reference to FIGS. 2-10.

Figure 1:
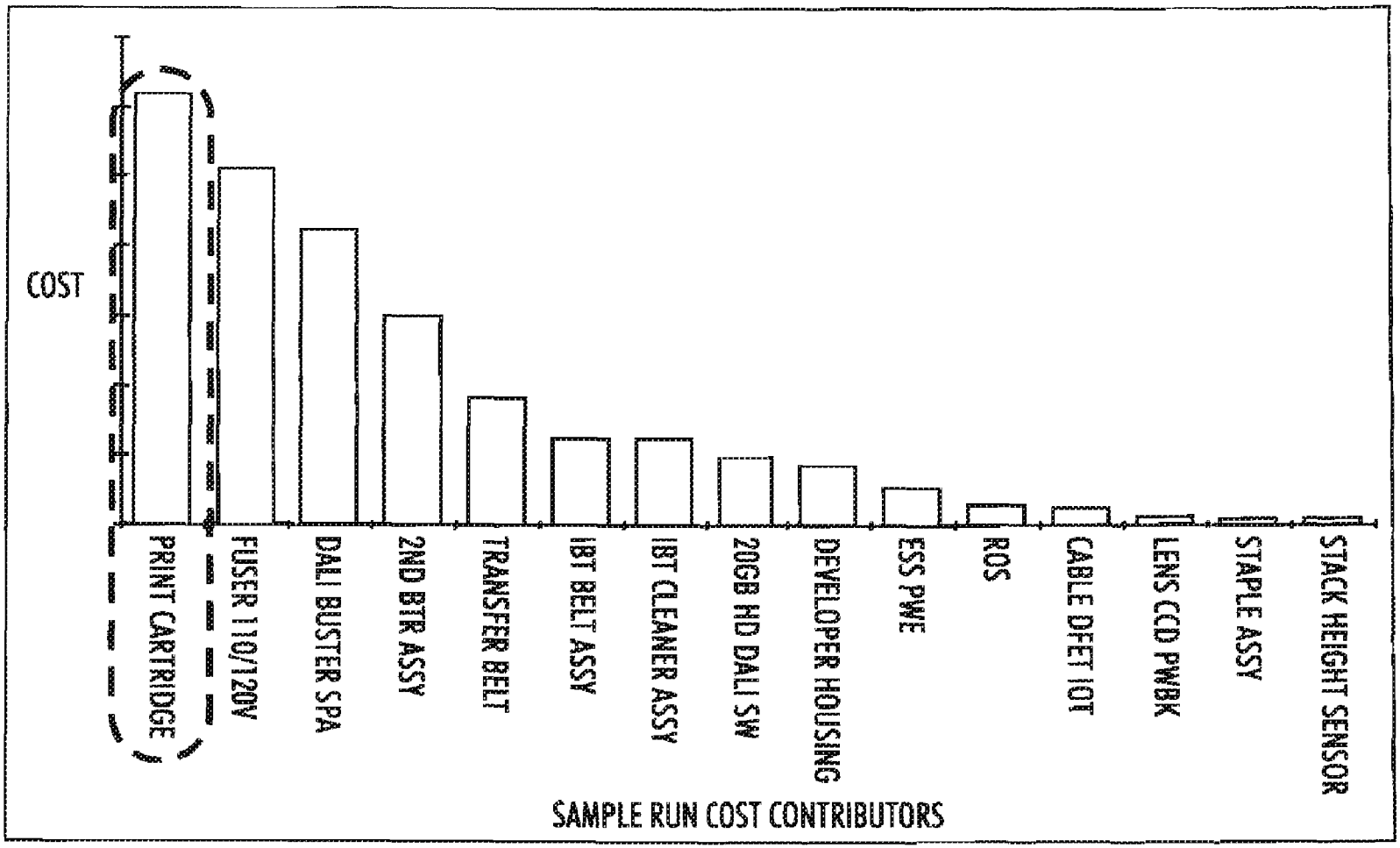
FIG. 1 illustrates a chart showing relative run cost contributors for a typical image forming apparatus, such as a xerographic device.
Figure 2:
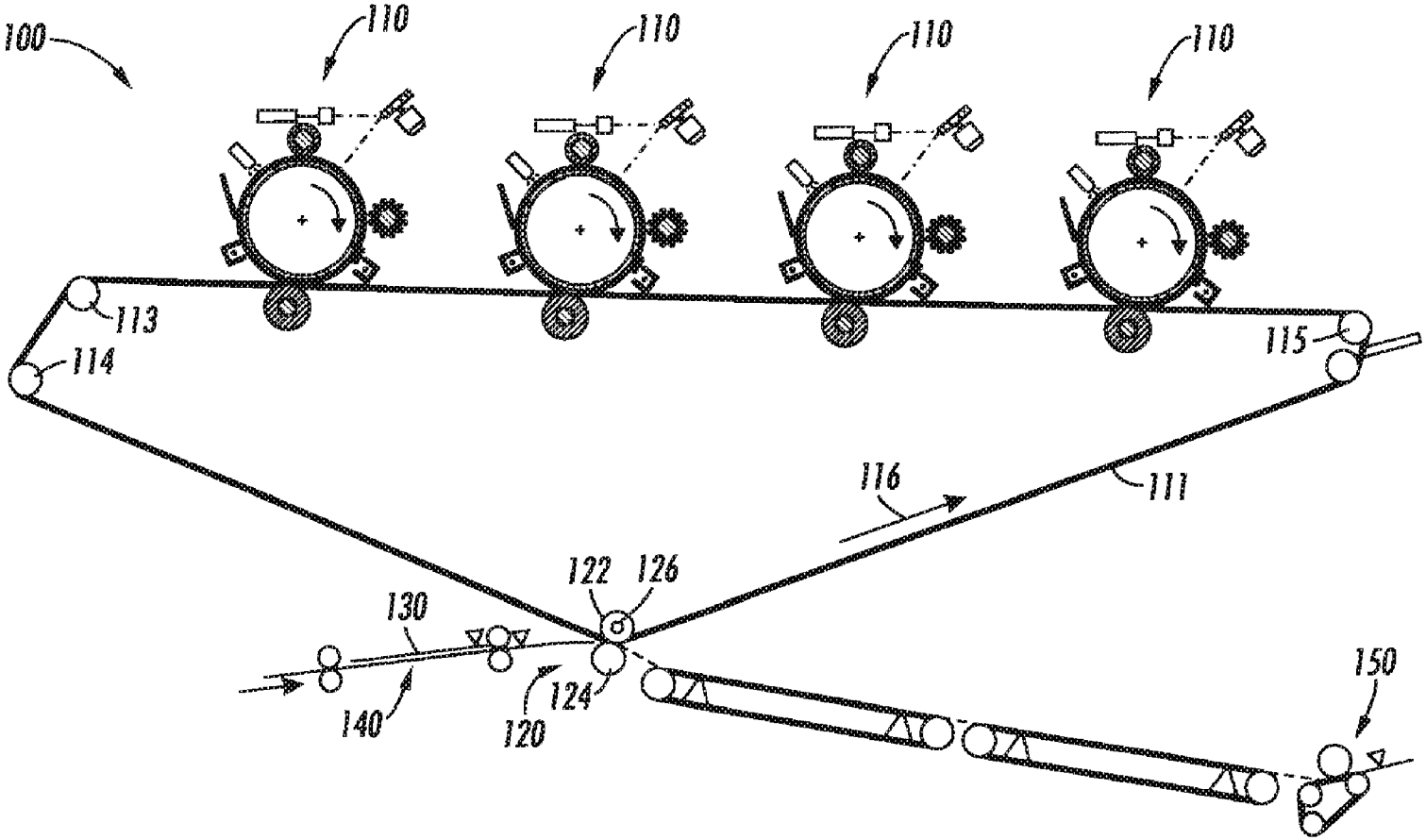
FIG. 2 is a schematic representation of a xerographic apparatus in which embodiments can be employed.

Referring to FIG. 2, a xerographic device 100, such as a copier, facsimile or laser printer, is shown schematically. Although embodiments will be described with reference to the drawings, it should be understood that embodiments can be employed in many alternate forms. In addition, any suitable size, shape or type of elements or materials could be used.

As shown in FIG. 2, the xerographic device 100 generally includes at least one image forming apparatus 110, each of substantially identical construction, that can apply a color of toner (or black). In the example of FIG. 2, there are four image forming apparatus 110 which can apply, for example, cyan, magenta, yellow, and/or black toner. The image forming apparatus 110 applies toner to an intermediate transfer belt 111. The intermediate transfer belt 111 is mounted about at least one tensioning roller 113, a steering roller 114, and a drive roller 115. As the drive roller 115 rotates, it moves the intermediate transfer belt 111 in the direction of arrow 116 to advance the intermediate transfer belt 111 through the various processing stations disposed about the path of the belt 111. Once the toner image has been completed on the belt 111 by having toner deposited, if appropriate, by each imaging apparatus 110, the complete toner image is moved to the transfer station 120. The transfer station 120 transfers the toner image to paper or other media 130 carried to the transfer station by transport system 1403. The media then passes through a fusing station 150 to fix the toner image on the media 130.

Many xerographic devices 100 use at least one biased transfer roller 122 for transferring imaged toner to sheet-type media 130 as shown and according to embodiments. However, it should be understood that embodiments can be employed with continuous rolls of media or other forms of media without departing from the broader aspects of embodiments. U.S. Pat. No. 3,781,105, the disclosure of which is hereby incorporated herein by reference in its entirety, discloses some examples of a biased transfer roller that can be used in a xerographic device.

As shown in FIG. 2, the transfer station 120 includes at least one biased transfer roller 122 on one side of the intermediate transfer belt 111. The transfer roller 112 forms a nip on the belt 111 with a backup roller 124 so that media 130 passes over the backup roller 124 in close proximity to or in contact with the complete toner image on the intermediate transfer belt 111. The backup roller 124 acts with the biased transfer roll 122 to transfer the toner image by applying high voltage to the surface of the backup roller 124, such as with a steel roller. The biased transfer roller 122 is mounted on a shaft 126 that is grounded, which creates an electric field that pulls the toner image from the intermediate transfer belt 111 onto the substrate 130. The sheet transport system 140 then directs the media 130 to the fusing station 150 and onto a handling system, catch tray, or the like (not shown).

Figure 3:
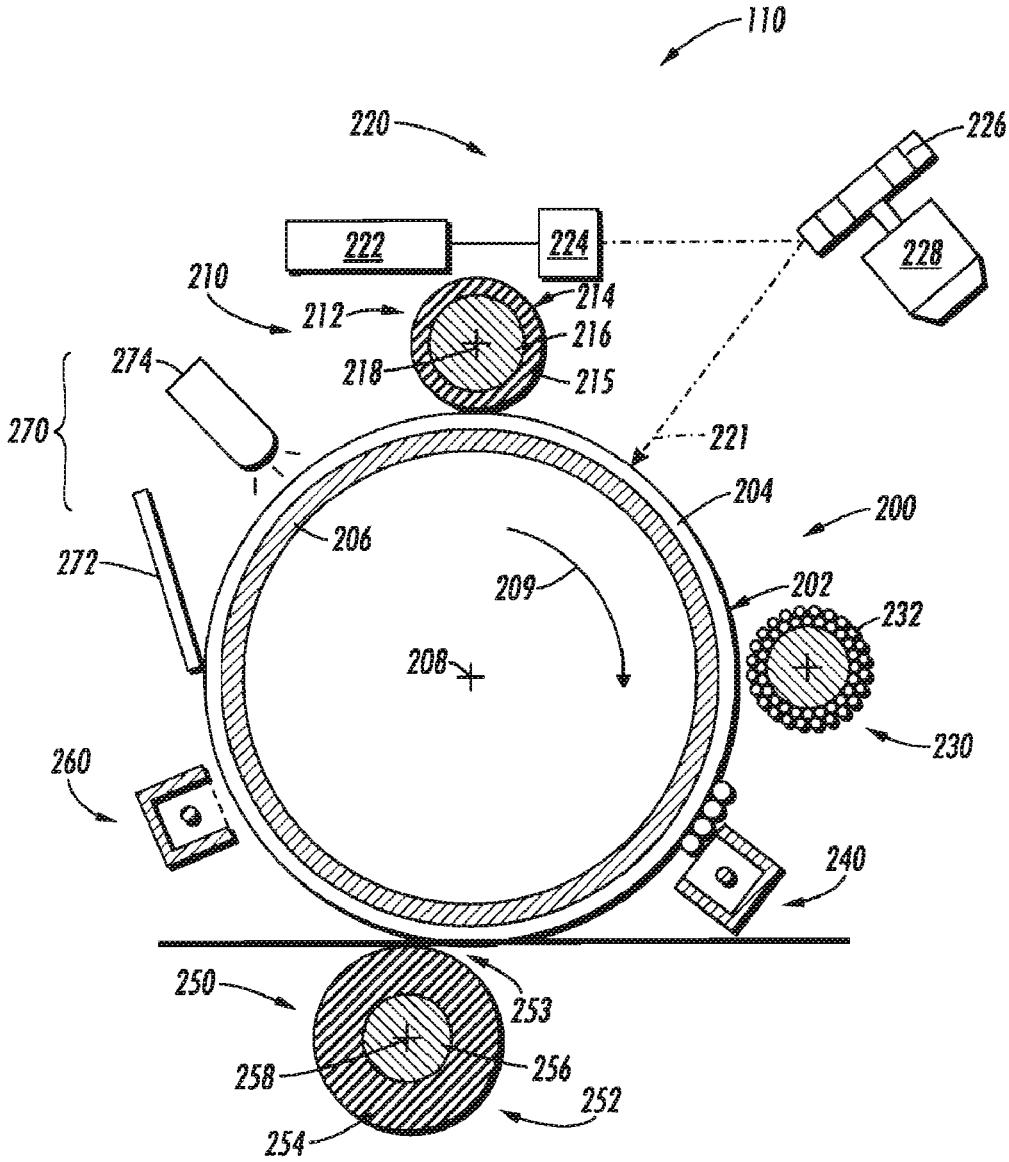
FIG. 3 is a schematic of an imaging apparatus in which embodiments can be employed, the imaging apparatus being part of a xerographic apparatus, such as that shown in FIG. 2.

Referring to one image forming apparatus 110 as an example, shown in FIG. 3, each image forming apparatus 110 may include a photoconductor 200, a charging station or subsystem 210, a laser scanning device or subsystem 220, such as a rasterizing output scanner (ROS), a toner deposition station or subsystem 230, a pretransfer station or subsystem 240, a transfer station or subsystem 250, a precleaning station or subsystem 260, and a cleaning/erase station 270. The photoconductor 210 of the illustrated embodiment is a drum, but other forms of photoconductor could be used, such as a belt. The photoconductor drum 210 may include a surface 202 of a dielectric layer 204 on which an electrostatic charge can be formed. The dielectric layer 204 may be mounted or formed on a cylinder 206 that is mounted for rotation on a shaft 208, such as in the direction of the arrow 209.

The charging station 210 includes a biased charging roller 212 that charges the photoconductor 200. Preferably, charging is by a DC-biased AC voltage supplied by a high voltage power supply (shown in FIG. 4). The biased charging roller 212 includes a surface 214 of an elastomeric layer 215 formed or mounted on an inner cylinder 216, such as a ceramic or steel cylinder, though any appropriate material could be used. The roller 212 is preferably mounted for rotation with a shaft 218 extending therethrough along a longitudinal axis of the roller 212.

The laser scanning device 220 may include a controller 222 that modulates the output of a laser 224, such as a diode laser, whose modulated beam shines onto a rotating mirror or prism 226 rotated by a motor 228. The mirror or prism 226 reflects the modulated laser beam onto the charged photoconductor surface 202, panning it across the width of the photoconductor surface 202 so that the modulated beam can form a line 221 of the image to be printed on the photoconductor surface 202. Exposed portions of the image to be printed move on to the toner deposition station 230, where toner 232 adheres to the exposed regions of the photoconductor. The image regions of the photoconductor, with adherent toner, then pass to the pretransfer station 240 and on to the transfer station 250.

The transfer station 250 may include a biased transfer roller 252 arranged to form a nip 253 on the intermediate transfer belt 111 with the photoconductor 200 for transfer of the toner image onto the intermediate transfer belt 111. In embodiments, the biased transfer roller 252 includes an elastomeric layer 254 formed or mounted on an inner cylinder 256, and the roller 252 is mounted on a shaft 258 extending along a longitudinal axis of the roller 252. Like the biased charging roller 212, the biased transfer roller 252 preferably carries a DC biased AC potential provided by a high voltage power supply 352, such as that seen in FIG. 4. In embodiments, the power supplies can be part of or replaced by a single power supply that provides DC biased AC voltages to both rollers 212, 252. The voltage applied to the roller 252 draws a toner image from the photoconductor surface 202 to the intermediate transfer belt 111. After transfer, the photoconductor surface 202 rotates to the precleaning subsystem 260, then to the cleaning/erasing substation 270, where a blade 272 scrapes excess toner from the photoconductor surface 202 and an erase lamp 274 equalizes the residual charge on the photoconductor surface.

Figure 4:
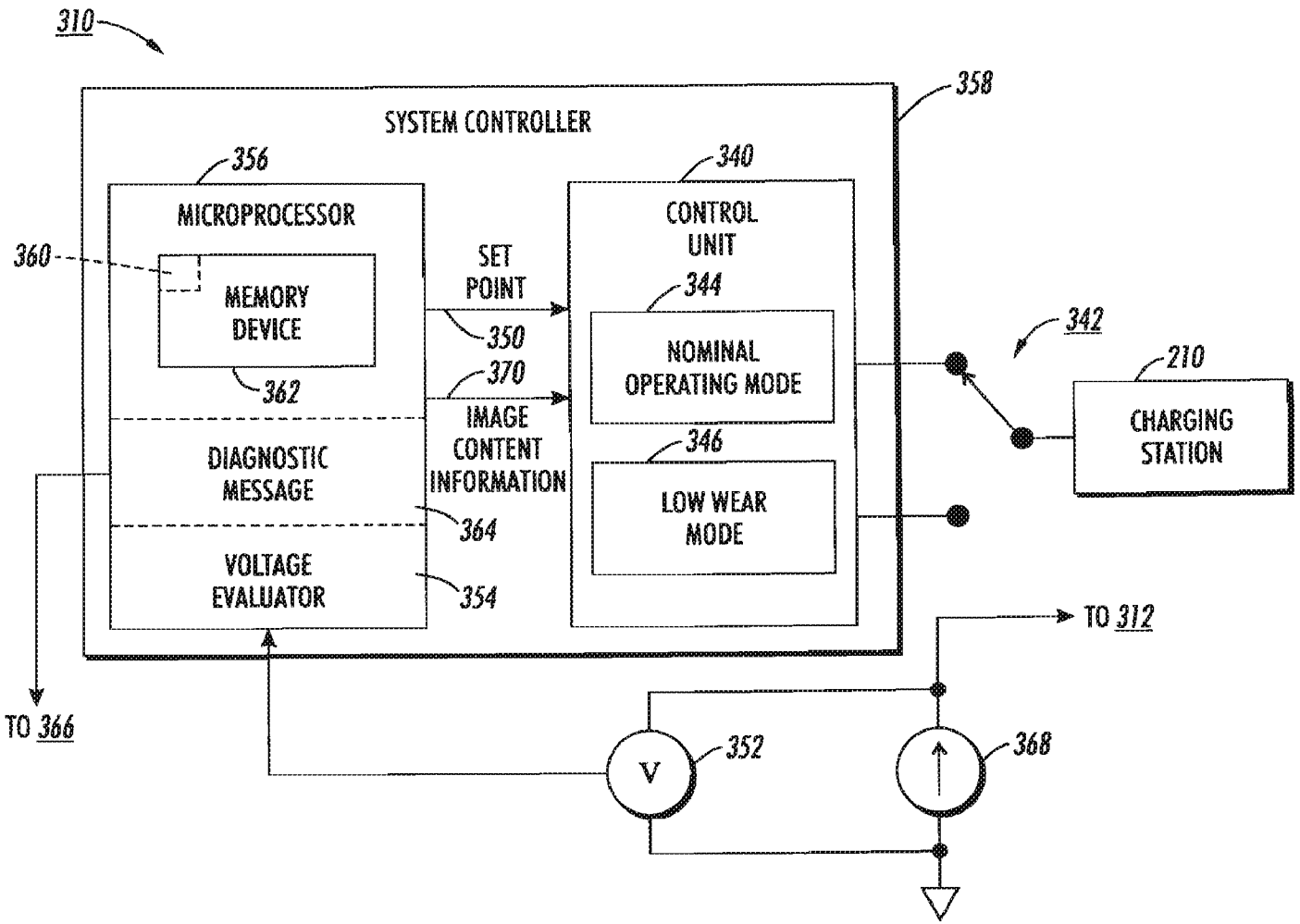
FIG. 4 is a schematic of the components employed in embodiments.

Referring to FIG. 4, an electronic control system 310 for the image forming apparatus 100 may include a system controller 358 in which at least one control unit 340 is connected to at least one charging station 210. In the case of a tandem print architecture as in FIG. 2, there may be multiple charging stations 210 (e.g. four as shown), each capable of separately being controlled by the at least one control unit 340. The at least one control unit 340 may include an operating mode selection switch 342 that selectively operates to control charging station 210 in one of a nominal operating mode 344 and a low wear mode 346. The controller 358 further includes a microprocessor 356 that can include a memory device 360 and can produce a diagnostic message 364 in response to a code and to a voltage regulator 354. The diagnostic message can be displayed on a user interface 366 of the image forming apparatus. Memory 360 may contain set point information 350, including actuator setting information for operation of the nominal operating mode 344 or the low wear mode 346 based on preset information or based on feedforward or feedback control.

The microprocessor 356 is preferably connected to a power supply 352 to enable adjustment of the current or voltage actuator applied to the biased charging roller 212 and/or biased transfer roller 252. In the example apparatus shown, the AC-biased charging roller 212 can be used in either constant current or constant voltage mode. In the constant current mode, feedback of current could be fed back to the microprocessor for control. The charging roller may also operate in a DC-only mode.

Many xerographic engines, particularly color xerographic engines, make use of biased charging rollers (BCRs), such as seen in FIGS. 2-4. BCR devices typically use an AC waveform (such as a sine wave) with a DC offset bias to exceed the required threshold voltage for air breakdown, $V_{TH}$, in pre-nip and possibly post-nip regions. $V_{TH}$ varies with the particular geometry of the print engine, thereby generating the desired photoconductor charging behavior. For this type of contact AC charging device, there are two major actuators that can be adjusted to affect the charging behavior: the amplitude (peak-to-peak) and the DC offset of the applied waveform.

Figure 5:
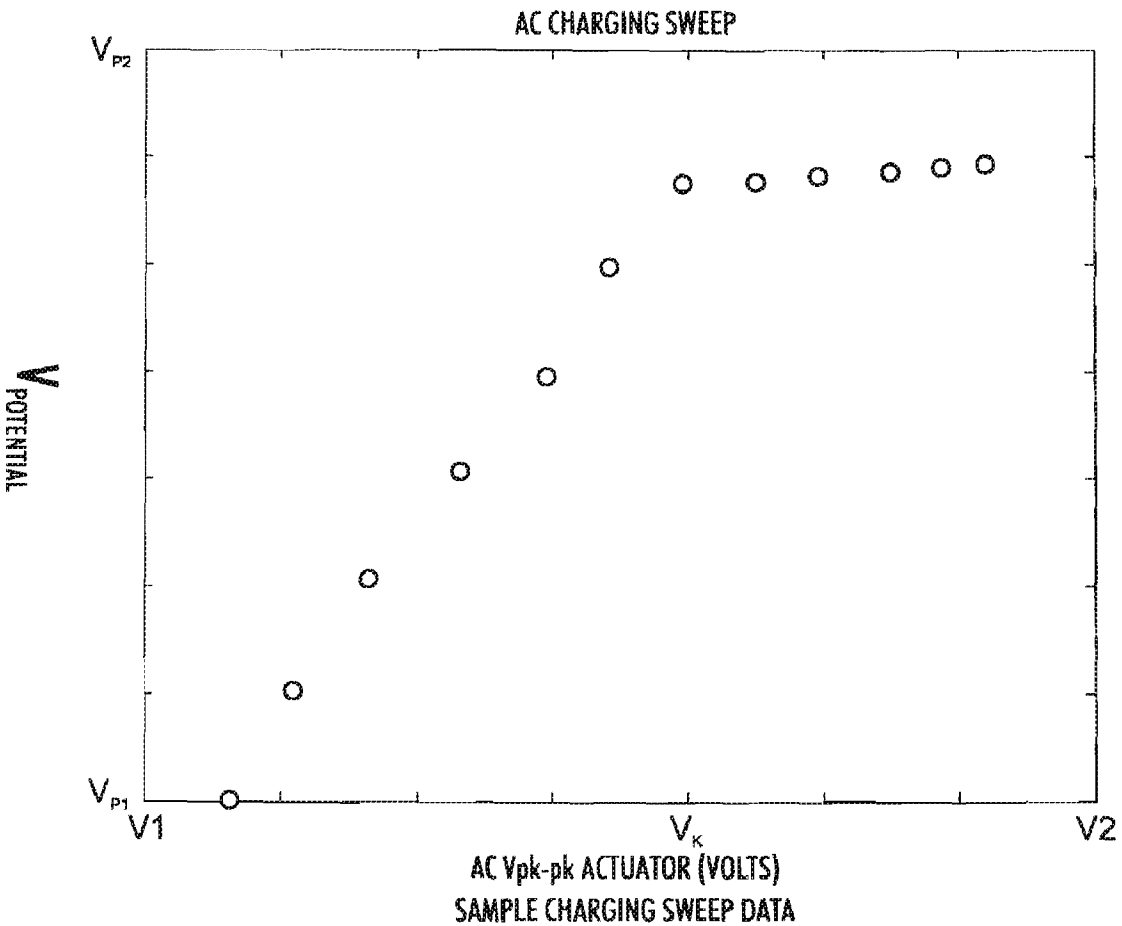
FIG. 5 illustrates an exemplary plot of AC charge device actuator voltage peak-to-peak versus a charged voltage output.

An example of the charger output (the charged photoconductor voltage $V_{high}$) of this type of device as a function of the AC peak-to-peak voltage actuator, with a fixed DC offset on the charging waveform, is shown in FIG. 5. From this plot, it can be seen that the amplitude actuator saturates at a certain peak-to-peak voltage, $V_k$, which for this system is a voltage between endpoint voltages V1 and V2 that could be applied to the photoconductor. Any further increase in this actuator has little or no impact on the photoconductor potential $V_{high}$. The saturation point of the actuator in this curve is often referred to as the "knee" of the charging curve as this is the location in the curve where it bends sharply like a knee. Other image forming apparatus may operate at different specific voltages and have a different curve characteristic.

Typically, non-uniform print quality is obtained for AC charging devices when the AC peak-to-peak actuator is operated below this knee value. In addition, under certain conditions, some print quality defects may occur for actuator values close to, but still slightly above, the knee of the charge curve. Thus, in most xerographic engines that make use of BCR charging devices, the peak-to-peak charging actuator is operated at a value sufficiently far above the "knee" of the curve to ensure acceptable output print quality despite variations in the process.

The magnitude by which the AC amplitude actuator exceeds the "knee" value shown in the curve in FIG. 5 has been found to be directly related to the wear rate of the photoconductor, with amplitudes much larger than the "knee" value resulting in much faster wear rates. It, is believed that this dependence is related to the amount of positive charge deposited onto the photoconductor surface by the charging device.

Thus, the magnitude of the AC charging voltage applied to the charging device can significantly affect the amount of positive charge deposition that occurs on the photoconductor surface. For a given DC offset voltage, larger peak-to-peak amplitudes for the applied AC voltage above the charging knee will typically lead to larger amounts of positive charge deposited onto the photoconductor surface for each charging cycle. Once again, the larger the amount of positive charge deposited onto the photoconductor surface by the charging device, the faster the photoconductor surface will wear. Thus, it is highly desirable to minimize the distance of the charging actuator above the knee of the charge curve to reduce wear.

Figure 6:
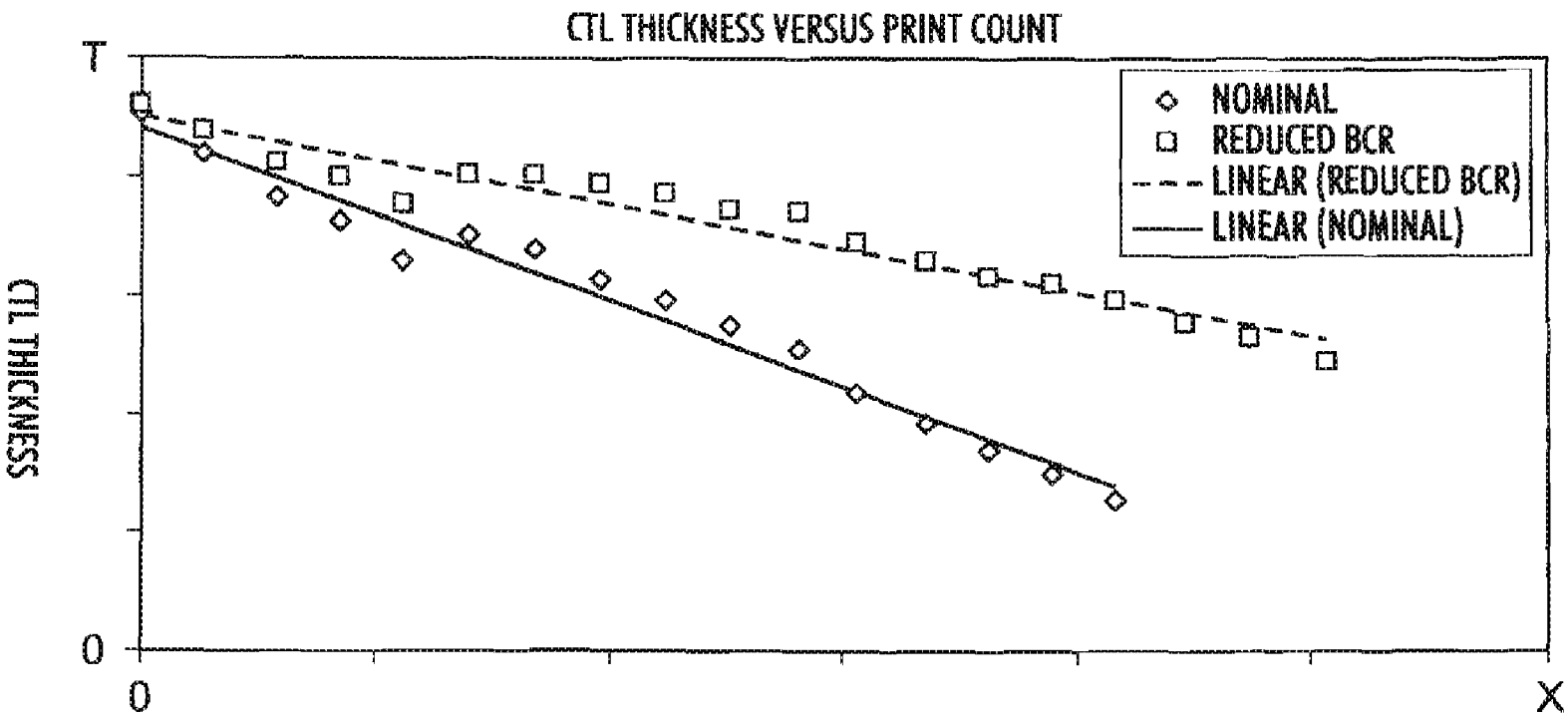
FIG. 6 illustrates a plot of photoconductor thickness to total print count showing wear dependence on charging current.

The plot of experimental data shown in FIG. 6 illustrates an example of the benefits of reducing the charging actuator in terms of reducing the photoconductor wear rate for an exemplary image forming apparatus. In this example, the reduced biased charge roll data was taken with an AC amplitude value much closer to the "knee" of the charging curve than a nominal case. This experimental data illustrates that it is possible to obtain at least a 2× improvement in the wear rate of the photoconductor through a reduction in the charging actuator settings.

Figure 7:
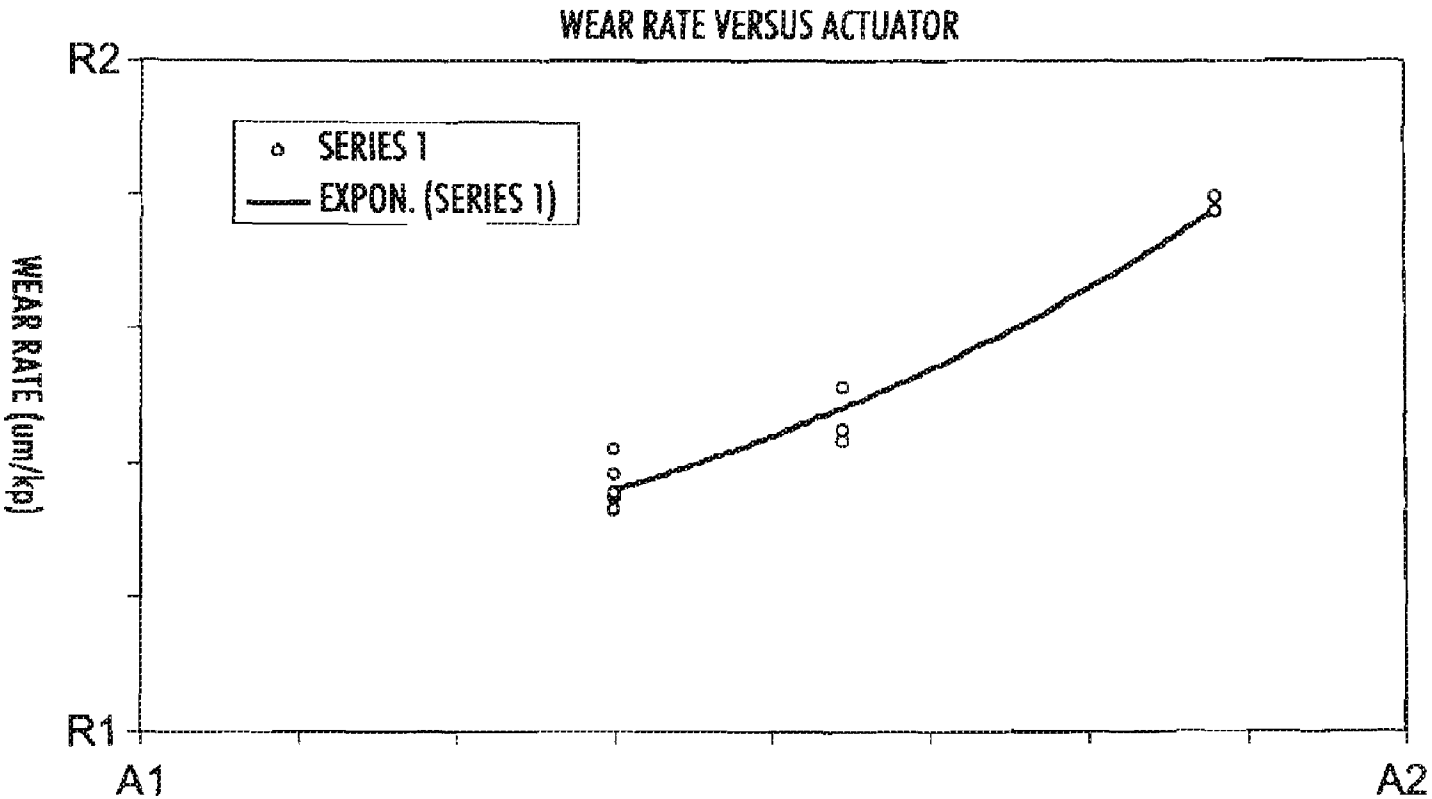
FIG. 7 illustrates a plot of photoconductor wear rate versus AC current charging actuation.
Figure 8:
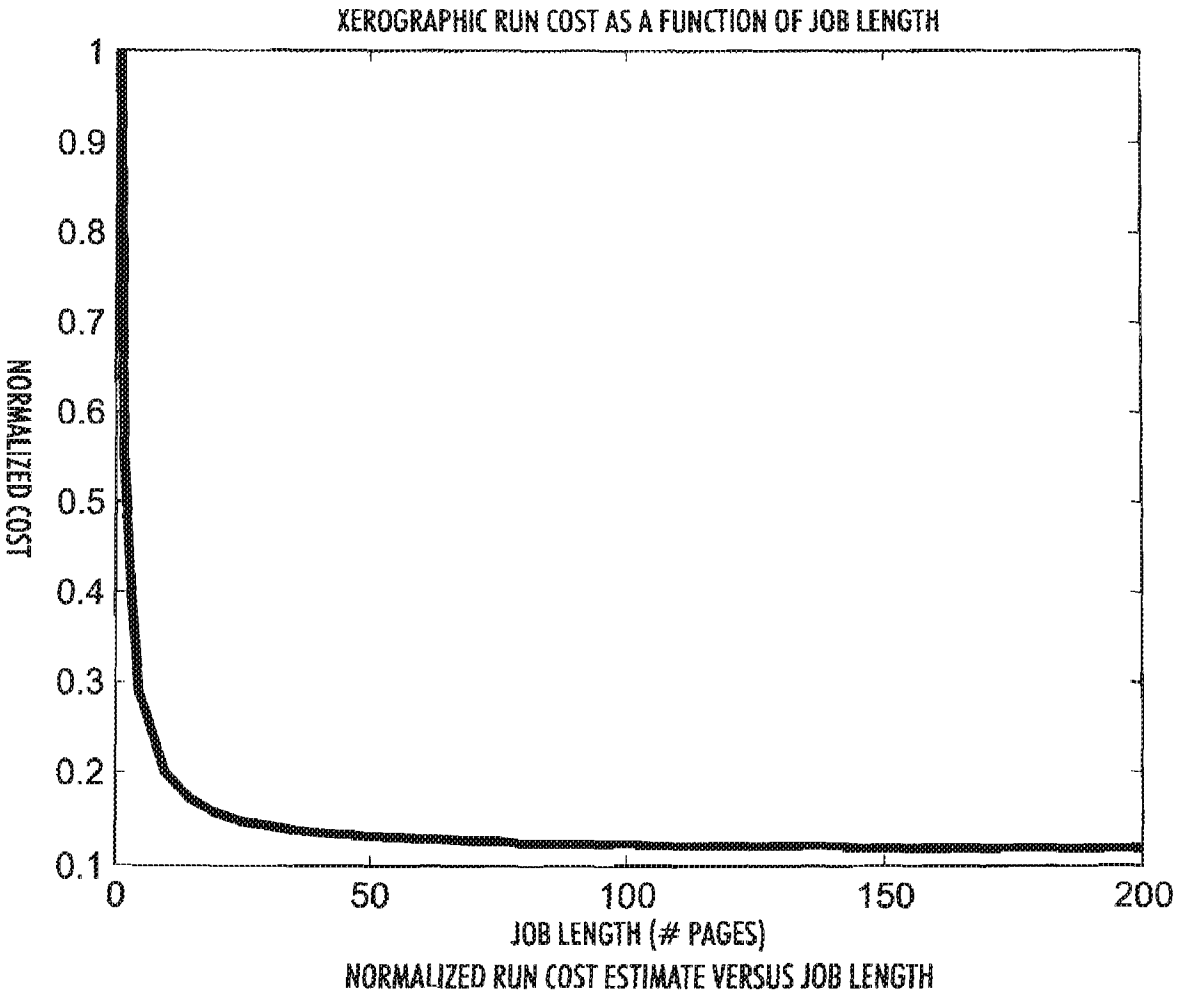
FIG. 8 illustrates a chart estimating a normalized run cost estimate versus a job length.

The graph in FIG. 7 further illustrates the dependence of the wear rate on the charging actuator. In this data, the biased charge roll (BCR) AC charging current is used as a surrogate for the AC amplitude of the biased charge roll waveform as the two are related linearly through the impedance seen by the charging device. In this experiment, the wear rate was tracked for several different values of the charging actuator. It is clear from this data that the wear rate can be significantly impacted through the appropriate setting of the charging actuator.

In many xerographic systems that make use of a contacting AC charging device, the AC charging actuator is not actively adjusted. The AC charging actuator is typically the amplitude of the AC voltage waveform for constant voltage mode charging, or the AC current setting for a constant current mode charging. However, the DC offset voltage for the AC charging device is, in many engines, adjusted as part of the normal process controls to help maintain consistent output. The AC charging actuator value of many xerographic printers is determined and set as part of the initial design of the engine. The AC charging actuator thus remains fixed and is not actively adjusted during normal operation of the image forming apparatus.

Because print quality defects are known to occur for charging actuator values close to or below the knee, larger design values for the AC actuator are typically chosen to ensure that variations in the process behavior over a broad range of potential printing conditions will not result in variations in the charging output voltage. However, these larger actuator values result in more positive ions being deposited onto the photoconductor's surface during each charging cycle (each cycle of the AC waveform). Once again, the wear rate of the photoconductor is related to the amount of positive charge deposition onto its surface, where an increase in positive charge deposition results in a decrease in the expected life of the photoconductor. Thus, a tradeoff is made at design time between the print quality latitude of the charging actuator and the amount of excess positive charge deposited onto the photoconductor surface (and therefore the expected wear rate of the device).

In an effort to limit the amount of positive charge deposited onto the surface of the photoconductor, while maintaining acceptable output print quality, some prior methods have attempted to design different AC waveform shapes. Another technique modulates the AC waveform in different ways, and other approaches have been used. However, each of these approaches has focused on altering the design of the AC charging waveform at design time, not making any active adjustments to the AC actuator during normal operation of the print engine.

Instead, to address the need for longer life photoconductor devices in systems with contact AC charging, many prior methods have focused on materials related solutions. These types of approaches can include such things as improved overcoats on the photoconductors to make them more durable. Unfortunately, these types of solutions are somewhat difficult to develop and can, in fact, cause other problems in the system. For example, creating a harder photoconductor surface in a xerographic system with a blade cleaning device shifts the wear to the cleaner blade, which can lead to reduced cleaning blade lives, which might not allow a significant gain in system run cost to be realized through such a materials based solution.

Still other methods have looked at using non-contact charging devices or other subsystem changes to reduce the abrasion of the photoconductor surface. But none of the prior methods have made use of active adjustment of the charging actuator during normal operation as a mechanism for mitigating the charging related impacts on photoconductor wear. Thus, there is a need for a xerographic system with such active adjustment to increase photoconductor life.

To take advantage of this wear rate dependence on the charging actuator, a related method is discussed in commonly-assigned, co-pending U.S. application Ser. No. (ID/20051613 by Burry et al), the subject matter of which is hereby incorporated herein by reference in its entirety. This method adjusts the charging actuator on-the-fly in order to track the "knee" of the charging curve through feedback. By decreasing the charging actuator as much as possible without impacting print quality, the method improves the run cost of the image forming apparatus by extending the photoconductor life. The charging actuator is adjusted relative to the "knee" of the charging curve throughout the entire print job by riding as close to the "knee" of the curve as possible without impacting print quality. In other words, all of the submitted pages of the customer jobs are printed using the same reduced actuator technique.

Furthermore, because the shifting of the charging curve occurs very slowly with time, the charging actuator used will most likely remain fixed throughout a given customer print job. Thus, the control settings are image data independent. Because of this, it is necessary to choose a set of actuator settings that are acceptable for even the most stressful image content, typically the most sensitive to charging related non-uniformities. This may place a restriction on just how low the charging actuators can safely be reduced without impacting customer print quality. Thus, such a technique also places a lower bound on the improvement in the photoconductor wear rate that is achievable through such a control strategy.

In accordance with exemplary embodiments of the disclosure, customer image content information is used in the choice of the actuator settings for charging devices, such as AC biased charge rolls. This allows the benefits of reducing the charging actuators to be further exploited in an effort to extend the life of the photoconductor.

Figure 10:
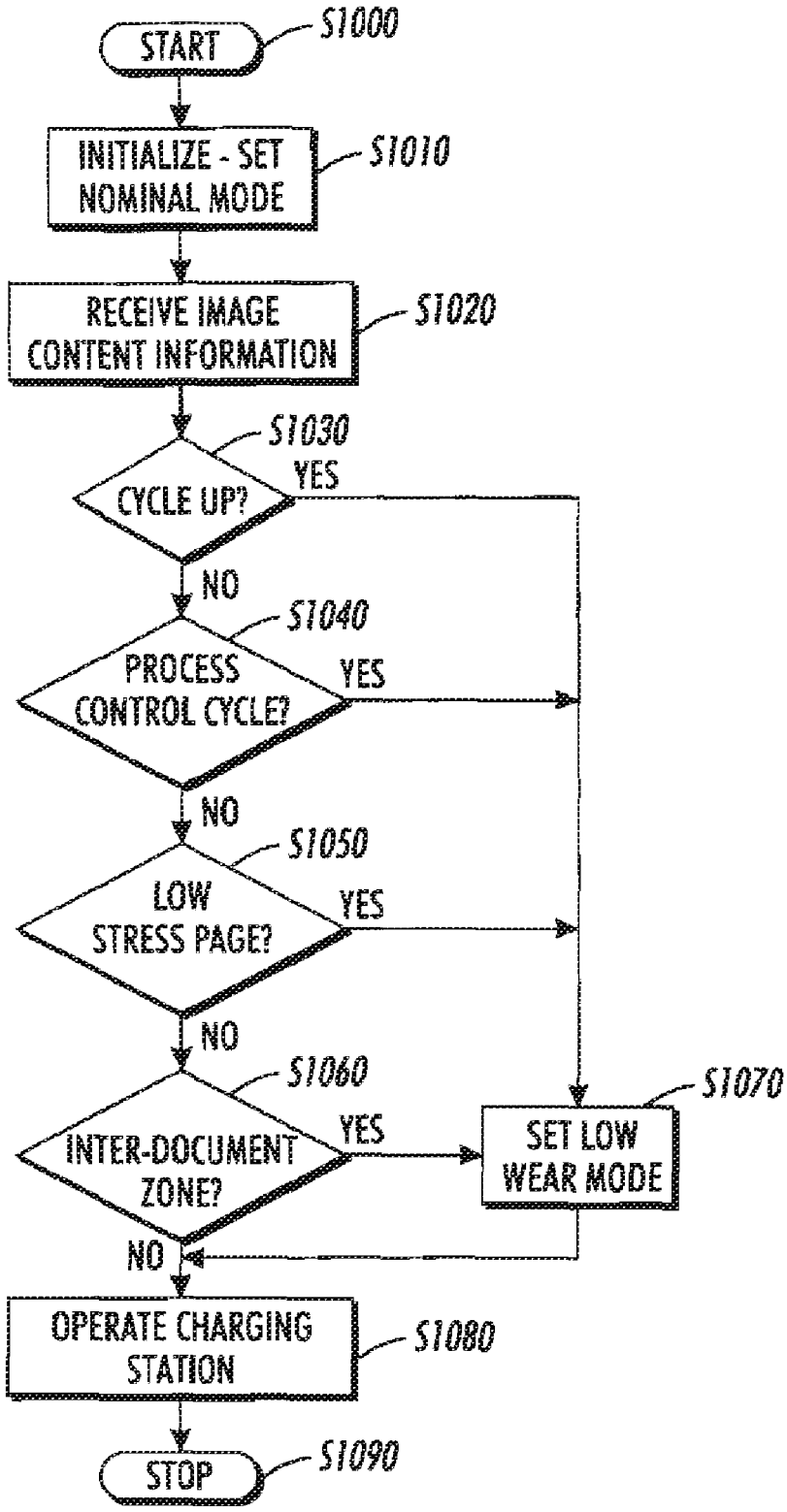
FIG. 10 illustrates a method of operating an image forming apparatus to achieve reduced photoconductor wear.

An exemplary method of setting charging station actuator settings will be described with reference to FIG. 10. The method starts at step S1000 and proceeds to step S1010 where the image forming apparatus is initialized and set in a nominal operating mode. Such a setting is typically optimized for printing with a high print quality and minimal print defects and is usually at or even well above the "knee" of the voltage potential curve shown in FIG. 5.

From step S1010, flow advances to step S1020 where image content information is received. This may be, for example, image data received form ROS 220 pertaining to one or more pages of data to be printed, or may contain data pertaining to the printing of one or more test patches, either in a printing zone on the photoconductor or in inter-document zones between pages to be printed. Such data may be received directly from ROS 220, or may be contained within memory 360.

From step S1020, flow advances to step S1030 where the control unit determines whether the image forming apparatus 100 is operating in cycle up (alternatively the control unit may determine cycle down). If so, flow advances to step S1070 where the low wear mode is set. If not, flow advances to step S1040. During the cycle up routine, at least one, but typically several cycles (revolutions of the photoconductor drum) are completed, without actual printing of output customer pages occurring, at the beginning of a print job to prepare the image forming apparatus for the printing job.

Because there is no customer image content printed during these routines, even though print regions of the photoconductor are subjected to charging, it is possible that the cycle-up and/or cycle-down routines for the image forming apparatus could be run with a reduced set of charging actuator settings (low wear mode). A normalized version of the estimated xerographic run-cost per-page for a given printer versus the length of the print job is presented in FIG. 8. The reason for the rapid increase in run-cost as the length of the job grows shorter is that, for shorter print jobs, the cycle-up and cycle-down time periods become a much larger percentage of the total run time for the print job, Thus, the "wasted cycles" that are spent in the cycle-up/cycle-down routines are consuming part of the useful lives of replaceable components in the system, such as the photoconductor. This drives up the run-cost per page. Such cycles are considered "wasted" because the machine is not printing useful output customer prints at this time. Because of this, the ability to run the charging actuators in a reduced mode of operation during these cycle-up/cycle-down routines may provide a significant benefit to the run-cost per page for short print jobs. For an exemplary printer, the physical number of photoconductor drum revolutions required for printing a standard 8.5"×11" page is 3.0 (excluding the inter-document zones the number of revolutions becomes 2.3). Through a lab experiment, it was determined that there could be as many as 25 extra drum cycles required for the cycle-up/cycle-down routines, in addition to the cycles required for actually printing the customer's image content. Thus, for a single page job, the number of drum cycles required could be as high as 28, rather than the 3 cycles physically required to actually print the customer's single page image content. This is more than a factor of nine increase in the number of photoconductor drum cycles required. Because the life of the photoconductor device in this exemplary image forming apparatus is directly related to the number of "high charge" cycles that the photoconductor has experienced, customers who print lots of short print jobs will have a substantial penalty in terms of the life of the photoconductor device. This is simply due to the "wasted" cycles in the cycle-up/cycle-down procedures. A "high charge" cycle is a drum cycle in which the biased charge roll is operating at its fill charging setpoint (nominal mode).

However, if the biased charge roll were operated in a reduced, low wear mode during these cycle-up/cycle-down procedures, then the net effect would be to make the average number of "high charge" cycles per page a constant, regardless of job length. This is because only those cycles actually required for printing customer image content would be operated in the "high charge" mode. In doing so, this would help to flatten the curve in FIG. 5, thereby reducing the average run cost per page for the system.

At step S1040, the control unit determines whether the image forming apparatus 100 is operating in a process control cycle. If so, flow advances to step S1070 where the low wear mode is set. If not, flow advances to step S1050.

During process control cycles, one or more test patches may be printed and measures for image quality purposes. When printing test patches for process control cycles, overall print quality uniformity is not necessarily of major concern. So long as the patches are not substantially impacted so as to disturb the process controls sensor reading of the test patches, a low wear mode of charging may provide acceptable performance. In an exemplary print engine, a "normal" printer operation requires a process control cycle, during which process control patches are printed and measured and color-to-color registration chevrons are also printed and measured, every 80 pages. Because this cycle takes approximately 3-4 pages to complete, in an average sense this works out to be approximately 4-5% of the machine's total run-time being spent on these process control cycles. By reducing the charging actuators during these cycles, a reasonable benefit to the overall run cost of the system may be provided.

One possible method to operate the low wear mode during such process control cycles is to use DC-only voltage rather than AC voltage. Of course, as with any other form of DC-only or unipolar charging operation, it may be necessary to provide a sufficient DC offset to maintain the same $V_{high}$ charge level on the photoconductor as was achieved in the bipolar region of operation. The reason for this can be clearly seen in FIG. 5 where the photoconductor voltage at the output of the charging device begins to decrease substantially below the "knee" of the charging curve. Thus, it may be necessary to offset this decrease in $V_{high}$ through an increase in the DC offset to the biased charge roll. Otherwise, a substantially different development performance may be achieved for DC-only or unipolar charging (operating below the knee) versus bipolar charging (operating above the knee) because the $V_{charge}$ and $V_{expose}$ levels on the photoconductor could be substantially different in the two cases.

At step S1050, it is determined by control unit 340 whether a particular page of the print job is a low stress page. If so, flow advances to step S1070 where the low wear mode is set. Otherwise, flow advances to step S1060. By selecting regions of the customer's job stream that are less susceptible to print quality issues due to reduced charger settings, the charging actuators can be further reduced where appropriate to reduce photoconductor wear without jeopardizing print quality. As a simple example, if a page, or even a portion thereof, does not require any cyan toner to be printed, then the cyan charging station can be run with a substantially reduced set of actuator settings (low wear mode) during this portion of the job stream without fear of impacting the output print quality.

In addition to use of reduced AC charge settings, based on the image content requirements, it may also be possible that the charging device can be run in DC-only mode (with zero AC amplitude) for certain portions of the job stream. This DC-only charging mode should be used only when running text or other non-stress images, since DC-only charging is more susceptible to non-uniformities in the output prints. However, operating in this mode, where appropriate, may provide a substantial benefit to the life of the photoconductor device because there would then be little to no positive charge deposition onto the photoconductor surface in these regions. Such implementations may enable reductions in electrical abuse of the photoconductor based on the image content of the customer's print job.

At step S1060, it is determined whether the photoconductor is in an inter-document zone. If so, flow advances to step S1070 where the low wear mode is set. If not, flow advances to step S1080.

As another example of the image content based biased charge roll control strategy, the inter-document zones in the customer's print job may be run with substantially reduced charger settings. In many office printers, the inter-document zones are not used for printing any image content, meaning that there is not even a set of process control patches printed in the inter-document zones. Instead, these engines periodically interrupt the print job to run a process control cycle where patches are printed and measured. Because nothing is being printed, the image quality is obviously not of concern in these inter-document zones areas. An exemplary method may then use these inter-document zone regions to substantially reduce the charging actuators. As an example of the potential impact of this strategy, consider a print engine operating in long-edge feed mode with standard 8.5"×11" paper in which the inter-document zones represents 25% of the total page time. This is essentially equivalent to 25% of the customer's job being available for a charging actuator reduction.

At step S1080, the charging station is operated based on the current setting, which may be either the nominal mode or low wear mode depending on the above conditions. If no more pages of the print job are needed, flow advances to step S1090 where the process stops. If additional pages of the print job remain, various processing steps can be repeated until the print job is complete. Because various conditions may be operated with low wear mode charging station actuator settings, it is possible to increase the life of the photoconductor and thus reduce the run-cost of the image forming apparatus.

Although not necessary to achieve benefits, various aspects of the disclosure may be supplemented through the use of an electrostatic voltmeter (ESV) to sense $V_{high}$ as a mechanism for determining the required biased charge roll DC offset voltage. As an alternative, one may use a mechanism that allows the use of the biased transfer roll or the biased charge roll device as an ESV, thereby eliminating the requirement for adding additional sensors to the system. Examples of these are disclosed in U.S. Pat. No. 6,611,665 and (ID#20051608 (DiRubio et al)), the disclosures of which are hereby incorporated herein by reference in their entireties.

Figure 9:
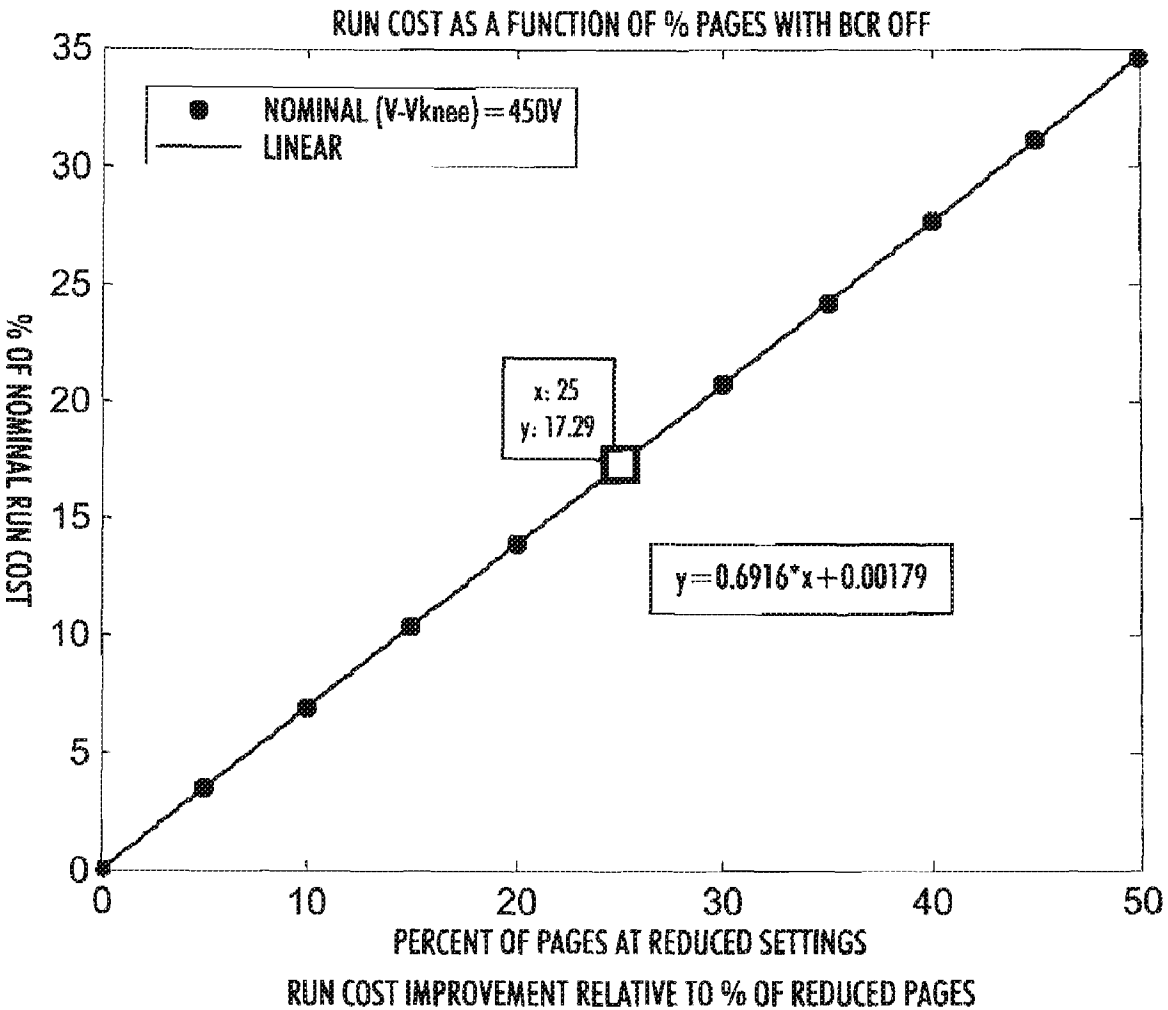
FIG. 9 illustrates a plot showing run cost improvements relative to a percentage of reduced pages.

The plot in FIG. 9 shows the results of a simulation of the photoconductor run-cost contribution for an exemplary micro-tandem color print engine as a function of the percentage of the print job stream in which the four charging devices (CMYK) are run at a significantly reduced settings (i.e., what percentage of the input job stream is available for operating the charging devices in their reduced wear mode). In generating these simulation results, it was assumed that the charging devices were operating at their nominal (higher wear rate) settings for the remainder of the job stream. The y-axis in the plot represents the expected run-cost benefit, as a percentage of the nominal run-cost. The y-intercept of the plot is zero because that represents the current state of affairs—zero run-cost improvement relative to today's operational mode. As a point of reference, the potential benefit to be gained through simply reducing the charging actuators to some minimal value during the inter-document zone regions (25% of the job time is spent in the inter-document zones) of the job stream is 17%. This is equivalent to a substantial improvement in the run-cost of the system simply for the case of taking advantage of the inter-document zone regions of the job stream.

The slope of the curve in FIG. 9 indicates that for each additional 4% of the customer's job for which a reduced set of charging actuators can be used, there is a corresponding improvement in expected run cost of approximately 3%. Thus, there are potentially significant further run-cost improvements beyond the simple inter-document zones strategy that can be achieved. If, for example, a customer job contains 10% text or other non-stress image content pages, then an additional 7% further improvement in the run-cost (beyond that for the inter-document zones strategy alone) for that particular print job could be achieved. This set of non-stress pages could include pages that were predominantly text with icons, graphics, or logos over only a small portion of the page. This allows the page to be run at reduced charger settings over all but the small graphic region.

The occurrence of the background disappearing point (BDP) related spots defect is an issue in many contact charging systems when the charging actuator is reduced below a threshold value (the threshold being the location of the background disappearing point). These spots defects occur at actuator values slightly higher than the knee of the charging curve (typically 200V or less) and are very objectionable to the customer. As such, their occurrence will most likely serve as a lower threshold for the charging actuator for some systems. Because the spots occur in both positive and negative forms, they are still of concern even when a particular color is not being utilized in the output image—the "positive" spots in under-charged regions can still make their way into the output image. However, these BDP spots do not appear to occur beyond a certain photoconductor age (about 10 k prints) for certain photoconductor materials formulations. Thus, substantial actuator reductions would be possible beyond this critical age boundary. In addition, these spots do not appear to occur for the DC-only charging mode. Thus, by reducing the AC actuator to zero (running in DC only mode), the occurrence of these defects could be avoided. Because the DC-only mode is expected to be the best case in terms of reducing the wear rate of the photoconductor due to charging, this would be the preferred actuator setting for the non-stress image regions anyway. For regions of the image that did not require a particular toner color, the positive spots could also be avoided in engines with intermediate transfer belts by simply detuning the first transfer device (turn first transfer off) associated with that particular toner color. This would prevent any image content (including BDP spots) that was developed onto the photoconductor for that color toner from appearing in the output prints.

It will be appreciated that various of the above-disclosed and other features and functions, or alternatives thereof may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. An image forming apparatus, comprising:

at least one photoconductor having at least one printing zone;

a photoconductor charging system selectively operable in one of a nominal charging mode and a low wear mode, the low wear mode operating at a reduced setting that reduces wear on the at least one photoconductor; and a control unit that receives image content information used to print an image in the at least one printing zone, wherein the control unit sets the photoconductor charging system to the low wear mode to charge the at least one photoconductor based on the image content information.

2. The image forming apparatus of claim 1, wherein the control unit sets the photoconductor charging system to the low wear mode when a low stress page is detected in the image data.

3. The image forming apparatus of claim 2, wherein the low stress page is substantially textual.

4. The image forming apparatus of claim 1, wherein the control unit sets the photoconductor charging system to the low wear mode during at least one of cycle up and cycle down operations to control charging of the at least one photoconductor over at least one print zone for at least one cycle of rotation of the at least one photoconductor.

5. The image forming apparatus of claim 1, wherein the control unit sets the photoconductor charging system to the low wear mode during at least one process control cycle that prints at least one test patch.

6. The image forming apparatus of claim 1, wherein the control unit detects from the image data that at least one photoconductor will not contribute to the printing during a next print cycle based on the image data and sets the photoconductor charging system associated with the at least one non-contributing photoconductor to operate in the low wear mode.

7. The image forming apparatus of claim 1, wherein the low wear mode is set by operating the photoconductor charging system in an AC mode at a reduced charge setting near or below a knee of the charging system charge curve.

8. The image forming apparatus of claim 7, further comprising a transfer system, wherein the transfer system is set to operate at a reduced transfer field when the photoconductor charging system is operating in the low wear mode to reduce transfer of defects.

9. The image forming apparatus of claim 1, wherein the low wear mode operates in a DC mode with a predetermined offset voltage.

10. The image forming apparatus of claim 1, further comprising a voltmeter that indicates a voltage setting of the at least one photoconductor and the control unit receives the indicated voltage setting as feedback.

11. A method of reducing wear of a photoconductor in an image forming apparatus that includes a photoconductor having at least one printing zone, a photoconductor charging system selectively operable in one of a nominal charging mode and a low wear mode, the low wear mode operating at a reduced setting that reduces wear on the at least one photoconductor, and a control unit, the method comprising receiving image content information used to print an image in the at least one printing zone of the photoconductor;

setting the photoconductor charging system to the low wear mode based on the image content information to charge at least one printing zone of the at least one photoconductor to reduce wear of the photoconductor.

12. The method of claim 11, wherein the control unit sets the photoconductor charging system to the low wear mode when a low stress page is detected in the image content information.

13. The method of claim 12, wherein the low stress page is substantially textual.

14. The method of claim 11, wherein the control unit sets the photoconductor charging system to the low wear mode during at least one of cycle up and cycle down operations to control charging of the at least one photoconductor over at least one print zone for at least one cycle of rotation of the at least one photoconductor.

15. The method of claim 11, wherein the control unit sets the photoconductor charging system to the low wear mode during at least one process control cycle that prints at least one test patch.

16. The method of claim 11, wherein the control unit detects from the image data that at least one photoconductor will not contribute to the printing during a next print cycle based on the image content information and sets the photoconductor charging system associated with the at least one non-contributing photoconductor to operate in the low wear mode.

17. The method of claim 11, wherein the low wear mode is set by operating the photoconductor charging system in an AC mode at a reduced charge setting near or below a knee of the charging system charge curve.

18. The method of claim 11, further comprising a transfer system, wherein the transfer system is set to operate at a reduced transfer field when the photoconductor charging system is operating in the low wear mode to reduce transfer of defects.

19. The method of claim 11, wherein the low wear mode operates in a DC mode with a predetermined offset voltage.

20. The method of claim 11, wherein the control unit receives a detected voltage setting of the at least one photoconductor and uses the setting as feedback to set the low wear mode.

21. An image forming apparatus, comprising:

at least one photoconductor having at least one printing zone;

a photoconductor charging system selectively operable in one of a nominal charging mode and a low wear mode, the low wear mode operating at a reduced setting that reduces wear on the at least one photoconductor; and a control unit that receives image content information used to print an image in the at least one printing zone, wherein the control unit sets the photoconductor charging system to the low wear mode to charge the at least one photoconductor when at least one of the following conditions are present:

during printing of a low stress page as detected based on the image content information;

during at least one of cycle up and cycle down operations to control charging of the at least one photoconductor over at least one print zone for at least one cycle of rotation of the at least one photoconductor;

during printing of at least one test patch in a process control cycle; and upon determination from the image content information that at least one photoconductor will not contribute to the printing during a next print cycle.

* * * * *